US005823461A

United States Patent [19]

Hartley et al.

[11] Patent Number: 5,823,461

[45] Date of Patent: Oct. 20, 1998

[54] NO-FOLD BACK SPLICER WITH ELECTROSTATIC WEB TRANSFER DEVICE

[75] Inventors: John J. Hartley, Powauleo; Richard D. Greer, Brookfield, both of Wis.

[73] Assignee: Faustel, Inc., Germantown, Wis.

[21] Appl. No.: 814,314

[22] Filed: Mar. 10, 1997

[51] Int. Cl.[6] ..... B65H 19/28; B65H 75/28

[52] U.S. Cl. ..... 242/532.3; 242/521; 242/526.1; 242/527.4

[58] Field of Search ..... 242/52.1, 526.1, 242/527, 527.4, 532.3, 532

[56] References Cited

U.S. PATENT DOCUMENTS

| | | | |
|---|---|---|---|
| 1,518,428 | 12/1924 | Hudson . | |
| 3,529,785 | 9/1970 | Mistele | 242/56 |
| 3,823,887 | 7/1974 | Gerstein | 242/56.2 |
| 4,422,586 | 12/1983 | Tetro | 242/56 |
| 4,530,265 | 7/1985 | Lee et al. | 83/337 |
| 4,948,061 | 8/1990 | Krimsky et al. | 242/58.3 |
| 5,368,253 | 11/1994 | Hartley, Jr. | 242/527.4 |

FOREIGN PATENT DOCUMENTS 2 105 688 9/1981 United Kingdom .

OTHER PUBLICATIONS

Simco brochure, *Chargemaster® Electrostatic Generating Equipment,* 1996.

Hurletron Incorporated brochure, *Hurletron® Ribbon Tacking* 777, 1987.

*Primary Examiner*—William Stryjewski

*Attorney, Agent, or Firm*—Nilles & Nilles, S.C.

[57] ABSTRACT

An apparatus and method of splicing a continuously moving web cuts and transfers the web to a new core for rewinding with a no-fold-back and wrinkle-free splice. The web is fed through a first nip point formed by a first introducer roll and a second cushioned anvil roll, and the web is through a second nip point formed by the second cushioned anvil roll and the new core. An electrostatic charging bar positioned downstream from the first nip point emits an electrostatic charge onto the web to temporarily adhere it to the second cushioned anvil roll. A rotatable cutting knife which is cooperatively engageable with the cushioned anvil roll cuts the web at a point downstream from the electrostatic charging bar but upstream from the new core thereby forming a tail and a new leading edge. The tail continues to be rewound about a finished roll. Because the new leading edge of the web has been electrostatically charged it remains stuck to the cushioned anvil roll until it reaches the new core. At that point, adhesive on the new core peels the new leading edge of the web off of the cushioned anvil roll and affixes it onto the new core. The web is thereafter rewound about the new core.

15 Claims, 5 Drawing Sheets

NO-FOLD BACK SPLICER WITH ELECTROSTATIC WEB TRANSFER DEVICE

BACKGROUND OF THE INVENTION

1. Field of the Invention

This invention relates to a splicing mechanism on a roll changing apparatus for cutting and transferring a moving web to a new core without stopping movement of the web. In particular, this invention relates to a method and apparatus for splicing the moving web without causing a fold-back or wrinkling of the web on the new core and transferring the web to the new core with the use of an electrostatic generating device.

2. Background of the Related Technology

Many commercial and industrial laminating, coating and film processing operations are conducted on high speed web handling equipment which operate continuously for long periods of time. Paper converting is one example of such an operation. Numerous kinds of plastic film are also processed in this manner. At the end of the processing line the web is wound lengthwise into a large parent roll or finish roll of material. In the processing of web materials, it is inefficient to stop the entire operation each time an individual roll of material needs to be changed. For this reason, rewinding devices have been developed for cutting and transferring a moving web onto a new core so that successive rolls of material may be continuously wound without interrupting the operation.

One such rewind device, commonly referred to as either a turnover rewind stand or turret rewinder, is disclosed in U.S. Pat. No. 3,529,785. A turnover rewind stand includes a pair of rotatable spindles or cores which the web is wound around. The two spindles are mounted on a turret, and by revolving or "turning over" the turret, the spindle containing a fully wound roll of web material is moved out of the rewinding position and a new core is simultaneously moved into the rewinding position. Upon severing the web, the new leading edge of the web is affixed to the empty new core to continue the rewinding of the web while the finished roll is removed from the rewind stand. This process, referred to in the trade as splicing the web "on the fly," may be repeated over and over in order to rewind a number of rolls successively for as long as the web processing line is in operation.

The transfer of the web to a new core is typically accomplished by affixing the web to the new core with a tacky adhesive, although other methods of affixing the web to the core exist. After the web is put in contact with the core, the web is severed with a knife at a point which is normally downstream from the new core. The web sticks to the new core and thereafter the web is rewound onto the new core.

Since this type of splicer involves cutting the web at a point which is downstream from the new core, this type of mechanism causes a portion of the web to fold-back on itself on the new core when the splice is performed. This fold-back results in a double thickness of the web and wrinkling of the web at the core which is undesirable. While the affects of the fold-back may be alleviated after a number of revolutions on the new core, the fold-back nonetheless results in a significant amount of wasted material. It is therefore desirable to provide a web splicing device which will not produce a fold-back. Instead the web material transferred to the new core should be fold and wrinkle-free from the very start.

Some devices have been developed in an effort to provide a "no-fold-back" transfer of a moving web. The applicant's prior U.S. Pat. No. 5,368,253, entitled Continuous Rewind With No-Fold-Back Splicer, is one such device. That device uses a perforated knife to cut the web at a point which is upstream from the new core. Gaps in the perforated knife leave a set of tabs which hold the web together until the cut seam reaches the new core. At that point, the "new" leading edge of the web becomes bonded to a strip of adhesive on the new core. The adhesive bond overpowers the tabs thereby causing the tabs to break. As a result, the tail of the web continues on its normal path to become rewound about the old finish roll, while the new leading edge becomes bonded to the new core. The splice is made without the usual fold-back encountered in conventional splicing operation.

While the above-described device has proven quite successful, certain combinations of material and web tension are prone to breaking the tabs prematurely, which prevents the new leading edge from reaching the new core. Also, some web materials are prone to sagging and wrinkling during the splicing operation. Such wrinkling results in the same problem of waste encountered with conventional fold-back splicing methods discussed above.

Other examples of no-fold-back splicers include the device disclosed in U.S. Pat. No. 4,422,528 to Richard S. Tetro (The Black Clawson Company) and a second device produced by IMD Corporation, which uses a vacuum to transfer the web to the new core during the splicing operation. However, both devices are extremely complex and are severely limited to handling a narrow range of materials and feed rates.

SUMMARY OF THE INVENTION

A splicing mechanism on a continuous rewind apparatus for cutting and transferring a moving web onto a new core with a no-fold-back and wrinkle-free splice is disclosed.

The primary elements of the splicing mechanism presented herein include a first roll, a cushioned second roll, a third roll which forms the new core, an electrostatic generating device, and a cutting knife. The first roll is positioned immediately adjacent to the cushioned second roll to form a first nip point for the web to pass through. Likewise, the cushioned second roll is positioned immediately adjacent the third roll (i.e. the new core)to form a second nip point for the web to pass through. The electrostatic generating device is positioned in close proximity to the cushioned second roll at a point which is downstream from the first nip point but upstream from the cutting knife. Finally, the cutting knife is positioned in close proximity to the cushioned second roll at a point which is downstream from the electrostatic generator but upstream from the new core.

The electrostatic generator is a device which emits an ion charge onto the web in order to temporarily bond or adhere the material to the surface of the cushioned second roll. When the cutting knife cuts the web, the tail of the web continues on its normal path to become wound around the old finish roll. Because the new leading edge of the web is electrostatically bonded to the cushioned second roll, it does not slip off, but remains there until it reaches the new core. At that point, adhesive on the new core peels the new leading edge off of the cushioned second roll and affixes it onto the new core. Thereafter the web is wound about the new core. As a result, the web is spliced and transferred to the new core without any fold-back or wrinkles.

The present invention may be used with either a straight knife which makes a clean cut through the entire width of the web, or with a perforated knife which makes a tab cut as disclosed in the applicant's U.S. Pat. No. 5,368,253, which is fully incorporated herein by reference. When used in conjunction with U.S. Pat. No. 5,368,253, the widest possible process window of tension, speed and web materials can be realized. In either case, the new leading edge is pasted smoothly and flatly onto the new core so that no fold-back or wrinkles occur on the initial windings of the new core.

The primary objects of the invention are therefore to provide an apparatus and method for changing rolls on a continuous rewind operation which produces a no-fold-back and wrinkle-free splice; to cut the web at a point before it reaches the new core and to control the web as it is introduced onto the new core; to provide a means for electrostatically charging the web in order to control its movement during the splice; to provide a means for applying an adhesive bond between the new leading edge of the web and the new core; to provide a means for transferring the new leading edge of the web to the new core such that the tail of the web is wound about the finished roll and the new leading edge is smoothly and flatly applied to the new core; and to provide a no-fold-back, wrinkle-free splicing mechanism which is adaptable for use in splicing a wide range of web materials on either high-speed or low-speed rewind operations.

Other objects and advantages of the invention will become apparent from the following description which sets forth, by way of illustration and example, certain preferred embodiments of the invention.

BRIEF DESCRIPTION OF THE DRAWINGS

The drawings, which constitute a part of the specification and include exemplary embodiments of the present invention, include the following.

DETAILED DESCRIPTION OF THE PREFERRED EMBODIMENTS

Figure 1:
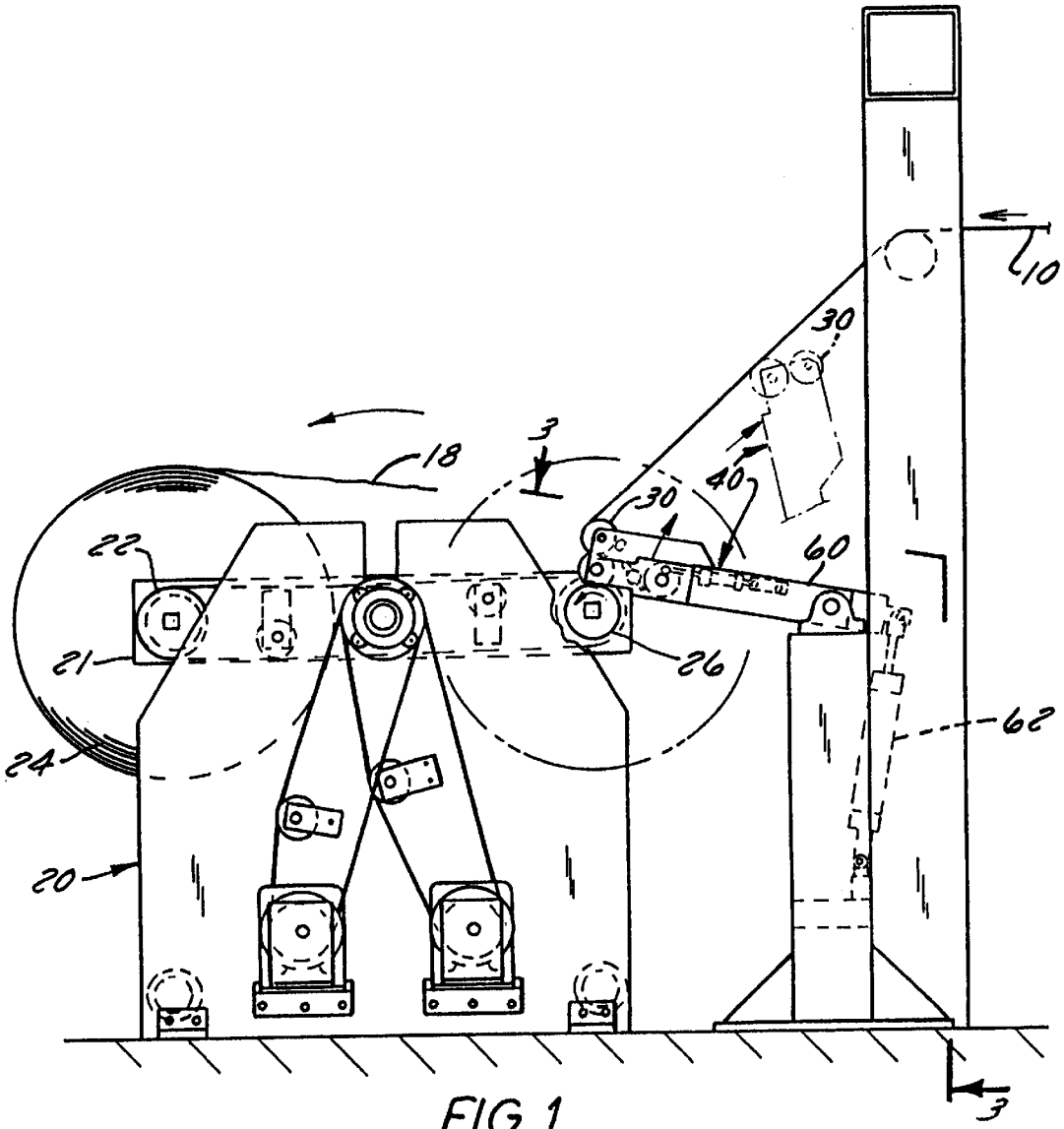
FIG. 1 is a side view of a no-fold-back splicing mechanism constructed in accordance with the principles of the invention.

The primary components of the present invention include a rewind stand 20 and a splicing mechanism 40. The rewind stand 20 is used to rewind a web 10 of paper, plastic, foils, laminations or other film material which has been processed on coating, printing, laminating, converting or other web handling equipment. The web 10 is rewound into large rolls, sometimes called parent rolls or mill rolls or finish rolls 24 for further processing or shipment to the customer. The rewind stand 20 should be a type capable of rewinding successively a number of rolls of material. The splicing mechanism 40 is used to splice the continuously moving web 10 and affix it to a new core 26.

As mentioned above, rewind stand 20 includes a pair of rotatable spindles or cores on each end of a turret arm 21 for rewinding the web. FIG. 1 shows a first core 22 which has a substantial amount of web material 24 wound around it. The first core 22 is situated on one end of the turret arm 21, and a second core 26 is situated on the opposite end of the turret arm 21. The rewinding operation is normally conducted in the position closest to the end of the processing line. By rotating the turret arm 21, the first core 22, which is ready to be finished and removed from the rewind stand, has been positioned away from the web processing line and the second core, i.e., the new core 26, has been simultaneously rotated into position to take over the rewinding operation. Once the splicing operation is completed, the finished roll 24 may be removed from the rewind stand 20 while the web material 10 continues to be rewound on the new core 26. When a sufficient amount of material has been rewound onto the new core, the turret is again rotated so that the web material may be rewound onto another new core, and so on.

Figure 2:
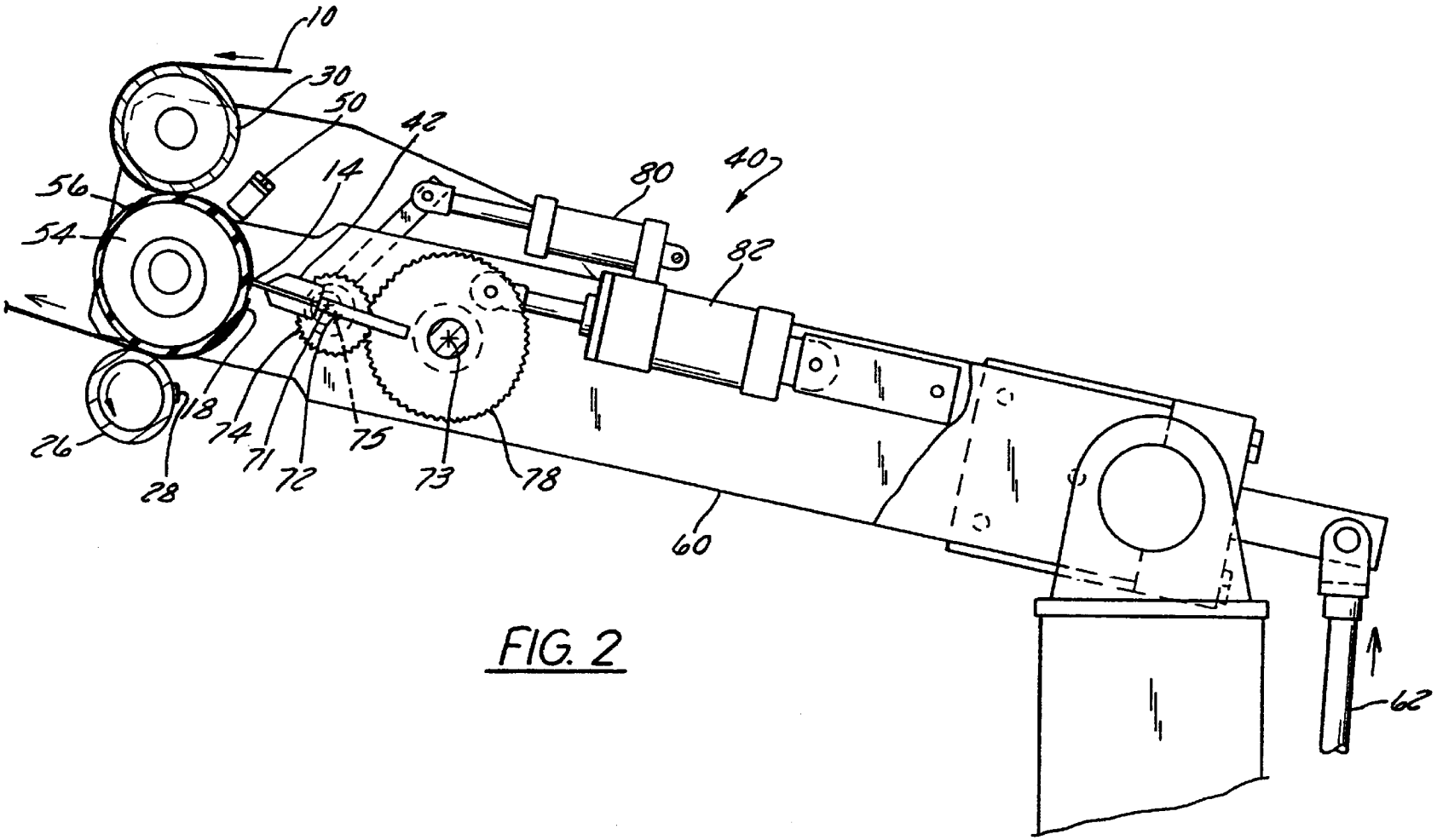
FIG. 2 is a detailed side view of the splicing mechanism, partially in section, showing the knife making a cut into the web.
Figure 3:
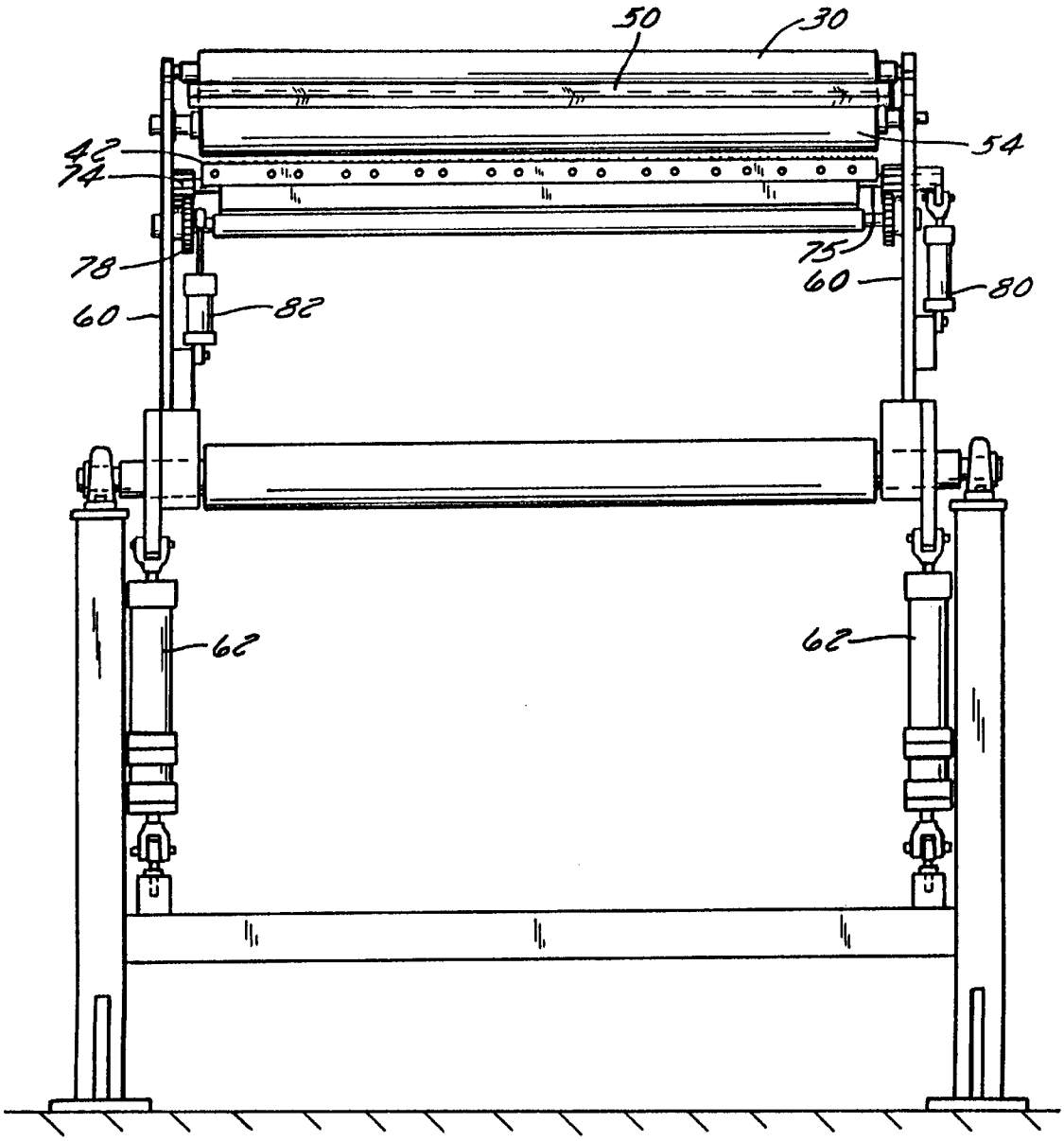
FIG. 3 is a front plan view of the splicing mechanism as shown along line 3—3 of FIG. 1.
Figure 4:
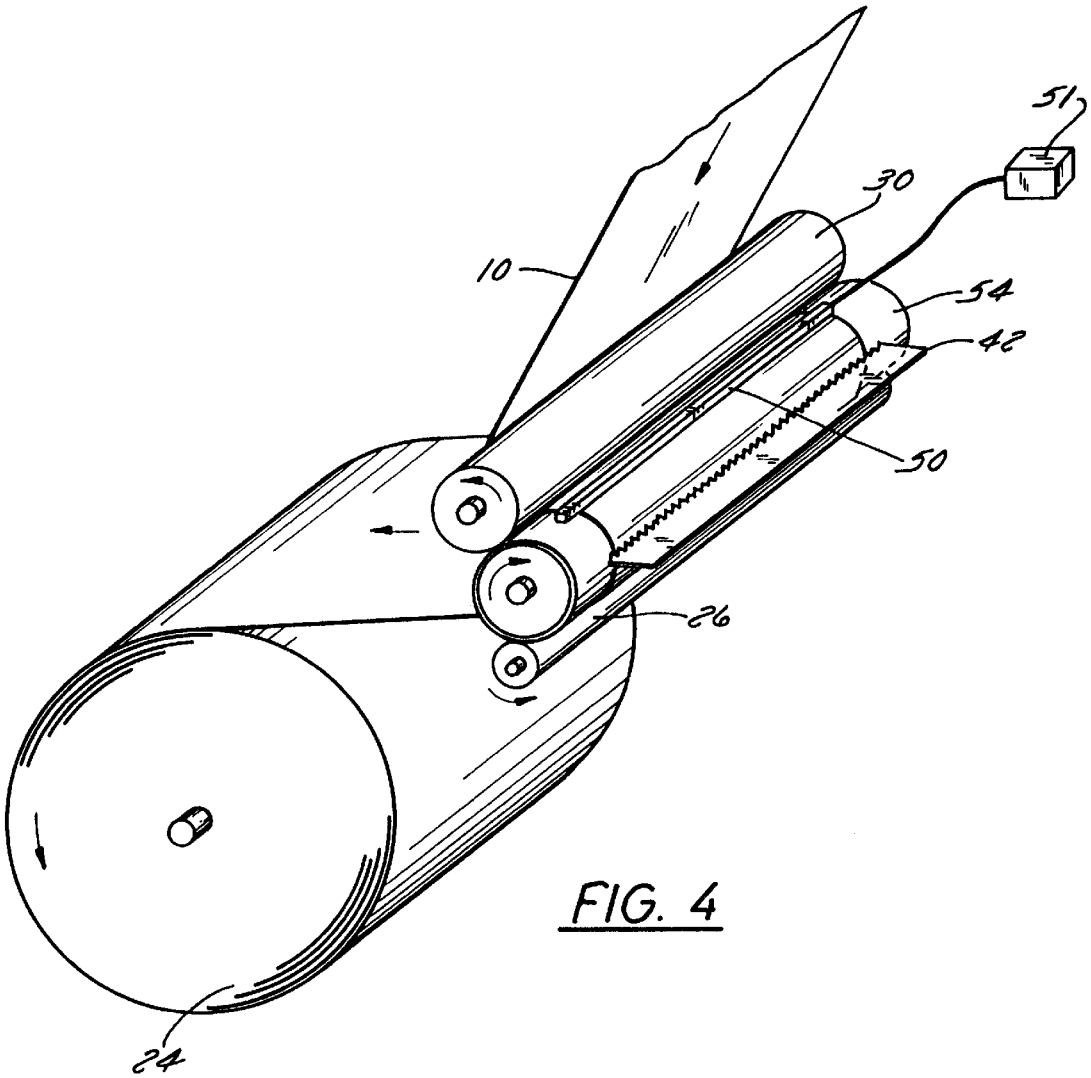
FIG. 4 is an isometric illustration of the essential elements of the splicing method disclosed herein.
Figure 5:
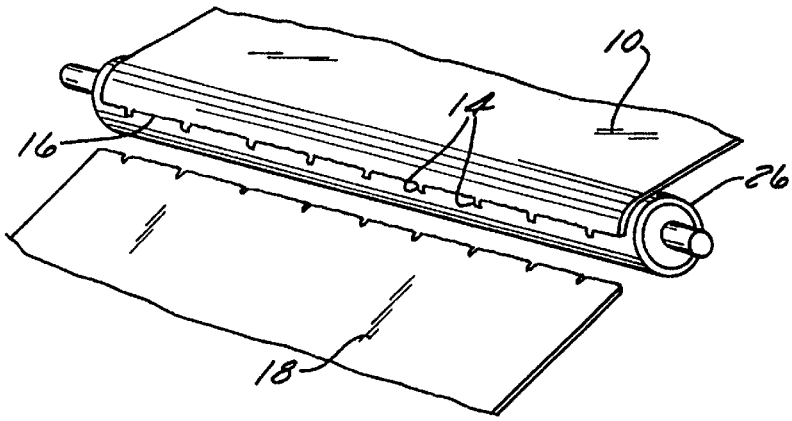
FIG. 5 is an isometric illustration of splicing the web using a tab-cut.
Figure 6:
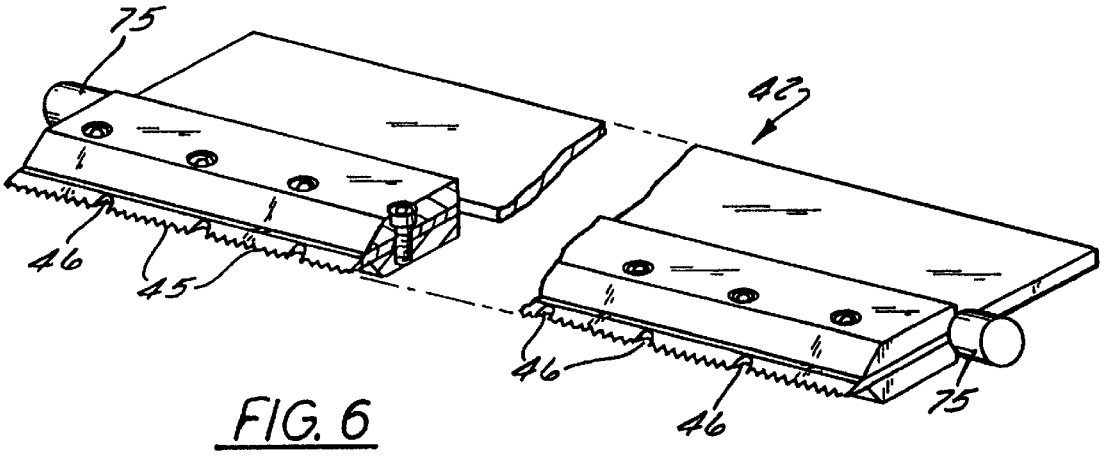
FIG. 6 is a perspective view of a perforated knife for making a tab cut.
Figure 7:
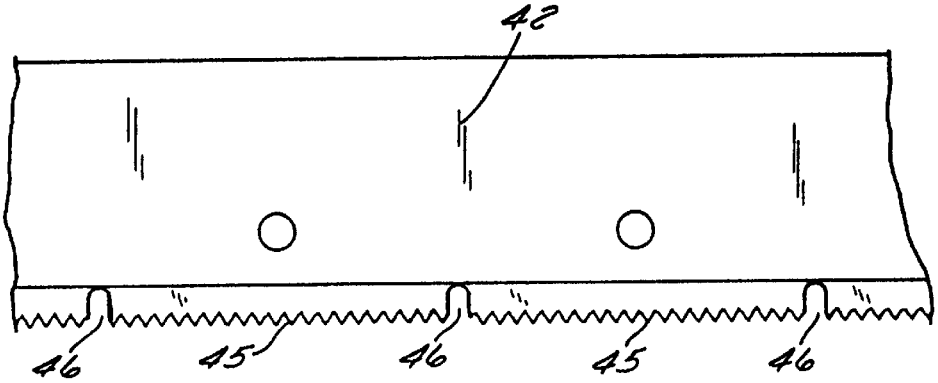
FIG. 7 is also a detailed view of a perforated knife showing the spaced apart gaps or reliefs which form the tab cut in the web.

The splicing mechanism 40 is preferably mounted on some type of retractable device or equivalent means for temporarily moving the splicing mechanism into a position near the new core 26 in order to perform the splice, but otherwise retracting the splicing mechanism away from the rewinder during normal operations. For example, the splicing mechanism 40 may be mounted on a pair of swing arm 60 on each side of the web 10 as shown in FIGS. 1, 2, and 3, which under the action of a cylinder 62 swing the splicing mechanism 40 from above down toward the new core 26. Initially a small gap is left between the web 10 and the new core 26. Just prior to performing the splice, the web is placed into contact with the new core at which time the splicing mechanism 40 severs the web 10 so that the tail 18 of the severed web 10 can continue on its way to be rewound onto the finish roll 24, while the new leading edge 16 of the web 10 is then affixed onto the new core 26 to continue the rewinding operation.

The splicing mechanism 40 includes a first roll 30 positioned immediately adjacent to a second cushioned roll 54 to form a first nip point for the web to pass through. The web 10 travels over the first roll 30 and through the nip point between the first roll 30 and cushioned second roll 54. Immediately downstream from that point, a static charging bar 50, connected to an electrostatic generator 51, is positioned across the width of the web 10 in close proximity to the cushioned second roll 54 so that the web 10 passes between the electrostatic charging bar 50 and the cushioned second roll 54. The electrostatic charging bar 50 emits an intense electric field of ions toward a ground point, which in this case is the cushioned second roll 54. The ion charge temporarily bonds or adheres the web 10 electrostatically to the surface of the cushioned second roll 54. Suitable electrostatic generators and charging bars are available from, for example, Simco, Hatfield, Pa., or from Hurletron Incorporated, Danville, Ill., as well as several other manufacturers of comparable products.

The splicing mechanism 40 further includes a cutting knife 42 which extends across the width of the web 10 at a location which is downstream from the electrostatic charging bar 50 but upstream from the new core 26. The knife 42 is preferably mounted on a rotatable knife holder such as a mounting bar 75 positioned across the width of the web 10. On the opposite side of the web 10 is the cushioned second roll 54 which acts like an anvil or cutting block in cooperation with the knife 42 in order to cut the web 10. The outer surface of the roll 54 is covered with a cushion 56 of rubber or similar material. As the web 10 passes over the cushioned roll 54, the knife 42 is cooperatively engaged into the cushioned roll 54. The edge of the knife 42 rotates at approximately the same arc speed as the outer surface of the cushioned roll 54, which also is the same linear speed that the web 10 is moving. Upon initiating the cutting action of the knife 42, the knife 42 may be allowed to freely rotate in a manner such that as the knife 42 initially engages into the web material 10 and then presses into the cushion 56, the knife 42 is carried through the cutting arc at the same speed that the web 10 and cushioned roll 54 are moving. This provides for a straight clean cut of the web material.

At about the same time that the cut is made, or just prior to it, the web 10 is pressed against the new core 26. The new core 26 consists of a long cardboard or metal tube commonly used to rewind web material and it has an adhesive coating applied around its outer circumference. The new core 26 initially engages a portion of the web 10 which is before the cut section or seam, i.e., the portion that will become the tail 18 of the finished roll 24. However, since the tail portion 18 is still intact across its entire width, that is, it is uncut, the internal strength of the tail 18 is stronger and thus overcomes the adhesive bond between the new core 26 and the surface of the web. Alternatively, and indeed preferably, the new core may be provided with only a narrow strip of adhesive tape 28 applied down the length of the new core 26, and in that case the cutting step is then synchronized with the rotation of the new core 26 so that the new leading edge 16 of the web 10 is applied directly to the narrow strip of adhesive tape 28 (discussed further below). In either case, the tail 18 is pulled past the new core 26 and continues on its normal course to be rewound onto the finished roll 24.

As the cut section or seam of the web continues on its path toward the new core, movement of the new leading edge of the web is controlled by virtue of the nip point between the first roll 30 and second cushioned roll 54, and, more importantly, by virtue of the electrostatic bond between the web 10 and the second cushioned roll 54. The web 10 is naturally under a certain amount of tension as it travels through the processing equipment. Unless it is held by some means, the severed web would be pulled backwards out of the splicer due to the web tension. The nip-point between the first and second rolls in combination with electrostatic bond between the web and the cushioned second roll keeps the web traveling in its normal path. In other words, the new leading edge 16 remains stuck to the surface of the cushioned second roll 54 even though the web has been severed. The nip-point between the first and second rolls also serves to flatten and smooth out the web and to eliminate any wrinkles or sags which may have developed upstream.

When the new leading edge 16 of the web 10 reaches the new core 26, the adhesive tape 28 on the outer surface of the new core 26 immediately sticks to the surface of the web. As mentioned above, the sequence of events are preferably synchronized so that new leading edge 16 is applied directly onto a narrow strip of adhesive tape 28 on the new core. This can be accomplished by placing a position sensor on the spindle for locating the relative position of the adhesive tape 28 on the new core 26, by calculating the speed and distance that the web 10 travels from the point that the web is cut to the point that it reaches the new core 26, and by controlling the timing of the cut made by the knife 42 so that the new leading edge 16 reaches the new core 26 at the same moment that the adhesive tape 28 comes in contact with the web 10.

In any event, because the adhesive bond between the new core 26 and the web 10 is stronger than the electrostatic bond between the cushioned second roll 54 and the web 10, the adhesive tape 28 on the new core essentially peels the new leading edge 16 of the web off of the cushioned second roll 54 and affixes it onto the new core 26, and does so without any fold-back, sags or wrinkles in the material.

The above described splicing method may be used with either a straight knife which cuts completely through the entire width of the web 10, in which case the placement of the new leading edge 16 onto the new core 26 is controlled electrostatically, or the cut may be made with a perforated knife 42 which partially cuts the web with a tab-type cut, in which case the placement of the new leading edge onto the new core is controlled electrostatically in combination with the tabbed seam between the tail and new leading edge. On a perforated knife, the length of the knife 42 consists of a series of relatively long sections 45 with sharp, pointed cutting edges. The long cutting sections 45 are separated by a set of narrow reliefs or gaps 46 located at spaced apart intervals along the length of the knife 42. When the knife 42 is passed into the line of travel of the web 10, the gaps 46 in the knife 42 result in only partially severing the web 10 material. The sharp edge sections 45 of the knife 42 cut completely through the material while the gaps 46 in the knife 42 leave behind tabs 14 of uncut material which hold the web 10 together.

As the cut section or seam of the web 10 continues on its path toward the new core 26, the tabs 14 hold the tail 18 and the new leading edge 16 together. When the cut section or seam reaches the new core 26, the adhesive bond between the new core 26 and the web material overpowers the tabs 14. As a result, the tabs 14 are broken and the leading edge 16 of the web material remains glued to the new core 26, while the tail 18 proceeds upon its normal path to be wound around the finish roll 24.

Once the knife 42 has made its cut into the web 10, the knife 42 may not be returned to its original pre-cut position by merely rotating back along the same arc of travel—it would cut into the web again. The splicing mechanism 40 must therefore include a means for retracting the knife 42 and resetting it to its original position. The embodiment of the invention described here utilizes an eccentric to retract the knife 42, although a number of other retracting means may work equally as well.

Details of the eccentric employed in the present invention, shown in FIG. 2, include a knife holder in the form of a pivotable mounting bar 75 for the knife 42, a knife holder support for circular member in the form of a first gear 74, a second gear 78, a first pneumatic cylinder 80 for actuating the knife 42, and a second pneumatic cylinder 82 for actuating the eccentric.

The knife mounting bar 75 is pivotable about a first axis 71. The first gear 74 is pivotable about a second axis 72 at its center. The knife mounting bar 75 is mounted on the first gear 74 and the first gear 74 is mounted on the swing arm 60, such that rotation of the first gear 74 results in rotation of the first axis 71 about the second axis 72. The second gear 78, also mounted on the swing arm 60, is likewise pivotable about third axis 73 at its center. The second gear 78 intermeshes with the first gear 74 at about a 2:1 ratio.

The knife 42 is initially in a retracted position such that the first axis 71 of the mounting bar 75 is positioned away from the cushioned roll 54. As the second pneumatic cylinder 82 for the eccentric is retracted, the second gear 78 rotates in a clockwise direction (looking at FIG. 2), which in turn rotates the first gear 74 counterclockwise, thereby rotating of the first axis 71 of the knife mounting bar 75 closer to the cushioned roll 54. The knife 42 is now located in a cutting position. The web 10 is then brought into contact with the new core 26, and immediately thereafter the knife activation cylinder 80 is actuated, thereby rotating the knife 42 counterclockwise downward through the web 10. The cut section of the web 10 then continues on and the new leading edge 16 is affixed to the new core 26 in the manner described above.

In order to retract and reposition the knife 42 the eccentric cylinder 82 is extended to rotate the second gear 78 counterclockwise (looking at FIG. 2), which in turn rotates the first gear 74 clockwise, thereby rotating the first axis of the knife mounting bar 75 away from the cushioned roll 54. The knife activation cylinder 80 then retracts to rotate the knife 42 back to the pre-cut position where it started. The splicing mechanism 40 is now ready to make another splice.

Finally, it is recognized that the present invention may be constructed in a number of configurations all of which satisfy the primary objective of providing a no-fold-back, wrinkle-free splice for changing rolls on a continuous web rewinder. For example, the splicing mechanism may be reconfigured onto a pair of arms which swing from above or below the new core, or mounted on a carriage in conjunction with or without a surface drive roll which slides the splicing mechanism toward and away from the new core in a linear motion. The knife may also be reconfigured to project in a linear direction to cut the web. Furthermore, alternative means for retracting the knife may be used other than an eccentric, or the knife may be driven by a servo motor synchronized with the web speed and thereby eliminate the need for retraction since the knife need not back up.

Therefore, specific details of the invention disclosed above are not to be interpreted as limiting, but merely as a basis for the claims and for teaching one skilled in the art to variously practice and construct the present invention in any appropriately detailed matter. Changes may be made in details of construction of the invention without departing from the spirit of the invention, especially as defined in the following claims.

We claim as our invention:

1. A method of splicing a continuously moving web comprising:

winding the moving web onto an old core of a rewinder;

positioning a new core upstream of the old core; and, splicing the moving web onto the new core, the splicing step comprising:

electrostatically charging the web at a location upstream of the new core in order to temporarily adhere the web to a roller;

cutting the moving web across its width at a location downstream from where the web is electrostatically charged but upstream from the new core, thereby producing a tail and a new leading edge;

placing the moving web in contact with the new core; and at a location downstream from where the web was cut, removing the new leading edge from the roller and affixing it onto the new core and thereafter winding the web around the new core.

2. The method of claim 1, further comprising, prior to cutting the web, feeding the web through a first nip point between an introducer roll and the roller, the roller comprising a cushioned anvil roll.

3. The method of claim 2, wherein the electrostatic charging step comprises emitting an ion charge onto the web to temporarily tack the web to the cushioned anvil roll.

4. The method of claim 3, further comprising, after cutting the web, feeding the web through a second nip point between the cushioned anvil roll and new core.

5. The method of claim 2, wherein the cutting step comprises rotating a cutting knife so that the knife cooperatively engages the cushioned anvil roll at substantially the same speed that the cushioned anvil roll is rotating to thereby cut the web.

6. The method according to claim 5, wherein the step of cutting the web further comprises activating the knife to cut the moving web, then retracting the knife away from the cushioned anvil roll, and repositioning the knife for another splicing operation.

7. The method according to claim 5, further comprising moving the knife and cushioned anvil roll in close proximity to the new core prior to splicing the web and moving the knife and cushioned anvil roll away from the new core after splicing the web.

8. The method of claim 1, wherein the step of affixing the new leading edge to the new core comprises:

applying adhesive tape onto the surface of the new core;

feeding the web through a nip point between the roller and the new core; and, advancing the new core so that the adhesive tape sticks to the new leading edge of the web and peels it off of the roller.

9. The method according to claim 1, wherein the cutting step comprises cutting the moving web with a series of relatively long cuts which extend completely through the moving web and leaving a set of uncut tabs in between the long cuts which hold the moving web together at a seam.

10. The method according to claim 9, wherein the step of affixing the web onto the new core comprises:

applying adhesive to the new core;

pressing the moving web against the adhesive on the new core;

pulling the tail portion of the moving web in order to break apart the tabs to produce the new leading edge of the moving web;

winding the tail portion of the moving web around a finished roll; and winding the new leading edge of the moving web around the new core.

11. An apparatus for splicing and transferring a continuously moving web onto a new core, the new core having an adhesive on the outer surface thereof, said apparatus comprising:

a first roll;

a second roll, said second roll comprising a cushioned anvil roll;

said first roll being positioned immediately adjacent to said cushioned anvil roll in order to form a first nip point for the web to pass through, and said cushioned anvil roll being positioned immediately adjacent to the new core in order to form a second nip point for the web to pass through;

an electrostatic charging bar located in close proximity to the cushioned anvil roll at a point downstream from the first nip point for temporarily adhering the web to the cushioned anvil roll; and, a cutting-knife positioned downstream from the electrostatic charging bar but upstream from the new core, the cutting knife being cooperatively engageable with the cushioned anvil roll for splicing the web to thereby form a tail and a new leading edge;

whereby, upon passing through to the second nip point, the adhesive on the new core peels the new leading edge of the web away from the cushioned anvil roll and affixes it onto the new core and the web is thereafter rewound about the new core.

12. The apparatus according to claim 11, further comprising means for advancing the apparatus into close proximity of the new core in order to perform the splicing operation and for retracting the apparatus away from the new core upon completion of the splicing operation.

13. The apparatus according to claim 11, further comprising means for repositioning the knife for a subsequent slicing of the web.

14. The apparatus according to claim 11, wherein the cutting knife comprises a perforated knife which is comprised of a series of relatively long longitudinally aligned sharp edge sections separated by reliefs, wherein the perforated knife is cooperatively engageable with the cushioned anvil roll for partially cutting the web with a tab-cut, and placement of the new leading edge onto the new core is controlled by the electrostatic bond between the web and the cushioned anvil roll in combination with the tab-cut.

15. The apparatus according to claim 11, wherein the adhesive on the new core comprises a narrow strip of double-sided adhesive tape extending longitudinally down the length of the new core, and the apparatus further comprises means for synchronizing rotation of the new core with the cutting action of the knife so that the new leading edge of the web is applied directly onto the strip of adhesive tape on the new core.

* * * * *